US008327465B2

(12) United States Patent
Arai

(10) Patent No.: US 8,327,465 B2
(45) Date of Patent: Dec. 11, 2012

(54) NECK PAD ATTACHMENT STRUCTURE (HELMET)

(76) Inventor: Michio Arai, Saitama-Ken (JP)

( * ) Notice: Subject to any disclaimer, the term of this patent is extended or adjusted under 35 U.S.C. 154(b) by 417 days.

(21) Appl. No.: 12/219,893

(22) Filed: Jul. 30, 2008

(65) Prior Publication Data

US 2009/0222977 A1 Sep. 10, 2009

(30) Foreign Application Priority Data

Mar. 6, 2008 (JP) ..... 2008-56286

(51) Int. Cl.

| | |
|---|---|
| ***A42B 3/00*** | (2006.01) |
| ***A42B 7/00*** | (2006.01) |
| ***A42B 1/24*** | (2006.01) |
| ***A63B 71/10*** | (2006.01) |

(52) U.S. Cl. ..... 2/415; 2/421; 2/422; 2/425

(58) Field of Classification Search ..... 2/410, 6.1, 2/6.2, 6.6, 411, 412, 413, 414, 415, 421, 2/422, 425, 9, 468; D29/101.2, 102, 103; 24/585.12, 604, 605, 629, 630, 631, 662; 403/329, DIG. 14

See application file for complete search history.

(56) References Cited

U.S. PATENT DOCUMENTS

| | | | | | |
|---|---|---|---|---|---|
| 1,823,229 | A | * | 9/1931 | Balbaud | 24/662 |
| 3,734,551 | A | * | 5/1973 | Hughes et al. | 292/17 |
| 4,553,270 | A | | 11/1985 | Hoffmann | |
| 4,598,430 | A | * | 7/1986 | Nava | 2/410 |
| 4,660,259 | A | * | 4/1987 | Ausnit | 24/585.12 |
| 4,697,289 | A | * | 10/1987 | Luigi | 2/422 |
| 5,412,810 | A | * | 5/1995 | Taniuchi | 2/424 |
| 5,469,606 | A | * | 11/1995 | Hansen | 24/662 |
| 6,003,212 | A | * | 12/1999 | Imahata | 24/581.1 |
| 6,182,338 | B1 | * | 2/2001 | Watanabe | 24/697.1 |
| 6,256,797 | B1 | * | 7/2001 | Nemoto et al. | 2/414 |
| 6,289,521 | B1 | * | 9/2001 | Ikeda | 2/421 |
| 6,308,343 | B1 | * | 10/2001 | Arai | 2/414 |
| 6,748,607 | B1 | * | 6/2004 | Hong | 2/422 |

(Continued)

FOREIGN PATENT DOCUMENTS

| | | |
|---|---|---|
| CN | 2407525 | 11/2000 |
| CN | 2598377 | 1/2004 |

(Continued)

OTHER PUBLICATIONS

English Abstract of CN 2598377.
English Abstract of CN 2407525.

*Primary Examiner* — Shelley Self
*Assistant Examiner* — Jane Yoon
(74) *Attorney, Agent, or Firm* — Dykema Gossett PLLC

(57) ABSTRACT

A neck pad is pulled out with a smaller force in an easy manner while assuring a positive characteristic of attached state of the neck pad.

An inserting plate that can be moved in a clearance S along a peripheral direction of a putting-on or taking-off opening is provided with a fitting part and in turn the fitting part is provided with an engaging part that is resiliently fitted in opposition to a pulling-out direction of the inserting plate through insertion of the inserting plate into the clearance S, the fitting part moves to a non-opposite position against the engaging part as the inserting plate moves in a peripheral direction to cause the fitted state of the engaging part to be released, thereby the inserting plate can be pulled out.

5 Claims, 8 Drawing Sheets

U.S. PATENT DOCUMENTS

| | | | | |
|---|---|---|---|---|
| 2004/0128744 | A1* | 7/2004 | Cleveland | 2/422 |
| 2006/0011805 | A1 | 1/2006 | Spruck | |
| 2006/0195973 | A1* | 9/2006 | Ikeda | 2/410 |

FOREIGN PATENT DOCUMENTS

| | | |
|---|---|---|
| JP | H6-4028 | 1/1994 |
| WO | 2006129028 | 12/2006 |

* cited by examiner

NECK PAD ATTACHMENT STRUCTURE (HELMET)

BACKGROUND OF THE INVENTION

1. Field of the Invention

This invention relates to a neck pad attachment structure in a helmet for use by the driver and/or passengers while operating various types of mobile vehicles such as a motorcycle and a four-wheeled automobile, watercraft such as a motorboat or moving equipment such as a bicycle.

2. Description of the Related Art

As the related art document information related to the present invention, Japanese Utility Model Laid-Open Publication No. H6-4028, for example, is provided.

This Japanese Utility Model Laid-Open Publication No. H6-4028 provides a description about an attachment structure for removably attaching the neck pad that is installed at a helmet for use by the driver and/or passengers while operating various types of mobile vehicles such as a motorcycle and a four-wheeled automobile, watercraft such as a motorboat or moving equipment such as a bicycle.

It is disclosed that the aforesaid neck pad attachment structure is made such that a vertical side part (an inserting plate) arranged at the neck pad is inserted between the shell and the shock absorbing liner, the fitting part of the vertical side part is fitted to the engaging part of the shock absorbing liner under its inserted state so as to cause the attached state of the neck pad to be held. It is further disclosed that under this attached state, it has actions and effects that when a tension force acts against the neck pad in a direction in which the neck pad is pulled out of the shell, the fitting part moves to the engaging part and their fitted state becomes more rigid.

In addition, it is disclosed that the aforesaid neck pad attachment structure is constituted such that the vertical side part is inserted between the shell and the shock absorbing liner when the neck pad is attached to the helmet, and the fitting part rides over the engaging part and is fitted to and attached to the engaging part. In addition, it is disclosed that when the neck pad is removed from the helmet, the end part of the neck pad (the end part of the engaging member constituting the neck pad) is pulled out in an outward direction to cause the fitting state of the fitting part in respect to the engaging part to be released from the end part toward the central part, thereby the neck pad is removed.

SUMMARY OF THE INVENTION

Further, the aforesaid removal of the neck pad generates both resistance caused by a contact between the fitting part and the engaging part and resistance caused by deformations of the fitting part and the engaging part when the fitted state of the fitting part in respect to the engaging part is released because the aforesaid removal is carried out by a pulling operation in which the fitted state becomes rigid, thereby a certain pulling force is required due to the resistances.

An object of this invention is an object to assure a positive characteristic of the neck pad fitted state and perform an easy removal of the neck pad by a smaller force.

In order to accomplish the aforesaid object, the neck pad attachment structure of this invention includes at least the following constitution.

That is, a neck pad attachment structure in which a neck pad for wearing comfortable comfort or stability of the helmet during use is removably attached to the helmet and provided with an inserting plate that can be freely inserted in an opening direction of a helmet putting-on or-taking-off opening part into a clearance between a shell constituting an outermost layer of the helmet and a shock absorbing liner installed in the shell is characterized in that the attachment structure enables the inserting plate to be moved along a peripheral direction of the putting-on or taking-off opening part within the clearance, the inserting plate is provided with a fitting part and in turn an engaging part where the fitting part is oppositely fitted in a pulling-out direction of the inserting plate is installed within the clearance, the fitting part and/or the engaging part has resiliency acted in a thickness direction of the helmet and when the inserting plate is inserted into the clearance in the case that the neck pad is attached, the fitting part rides over the engaging part under resiliency, and upon completion of insertion, the fitting part is resiliently fitted to the engaging part in a direction in which the fitting part prevents the inserting plate from being pulled out of the engaging part, and as the inserting plate moves in a peripheral direction, the fitting part moves to a non-opposing position in respect to the engaging part to cause the fitted state of the engaging part to be released, thereby the inserting plate can be pulled out.

The neck pad attachment structure is characterized in that there is provided biasing means for biasing the inserting plate toward the engaging part and motion of the inserting plate in its thickness direction within the clearance is restricted by a biasing force of the biasing means.

The helmet as defined in this invention may be applied in any of a full-face type helmet or an open-face type helmet as long as it has a construction in which the neck pad is installed in it.

The neck pad as defined in this invention is a member contacted with the neck part of helmet-wearer and installed at a scope ranging from the rear head part of the helmet putting-on or taking-off opening to the side head portions. In addition, the neck pad of this invention functions to assure wearing comfort or stability of the helmet when worn, with each of the members constituting the inner liners such as a head pad in contact with the head part, cheek pads in contact with the cheek portions and a chin pad contacted with the chin part of a helmet-wearer (a full-face type helmet) and the like, respectively.

The inner liners are constructed such that some cushion members are molded by urethane foam or a raw material having a softness similar to that of the urethane foam into shapes corresponding to the neck, head, cheeks and chin in the helmet, and are enclosed by a cover member having either softness or elasticity.

The shell as defined in this invention constitutes the outer most layer of the helmet that is molded into a predetermined shape (a full-face type helmet shape, an open-face type helmet shape), for example, by applying fiber reinforced resin material (GFRP, CFRP and the like) immersed with thermosetting resin material (epoxy resin material, phenol resin material and the like) or thermoplastic resin material (polycarbonate and the like) to fiber reinforced material (carbon fiber, glass fiber and the like).

The shock absorbing liner as defined in this invention is one that is molded into a shape corresponding to the head part of the shell by applying foamed polystyrene material or raw material having a shock absorbing performance similar to that of polystyrene material and the shock absorbing liner is installed inside the shell.

The helmet putting-on or taking-off opening as defined in this invention is an opening that a helmet-wearer puts on or takes off a helmet, and this opening faces downward (toward the shoulders of the helmet-wearer) when the person has the helmet on. In addition, a shape of the putting-on or taking-off opening in a full-face type helmet is an elliptical shape enclosing an entire periphery of the neck part of the helmet-wearer, and a shape of the putting-on or taking-off opening in an open-face type helmet is a semi-circle shape enclosing a scope ranging from the rear head part to the side head portions of the helmet-wearer.

BRIEF DESCRIPTION OF THE DRAWINGS

FIG. 7 is a sectional view taken along line VII-VII of

FIG. 4 for showing it in a developed view.

DESCRIPTION OF THE PREFERRED EMBODIMENTS

Figure 1:
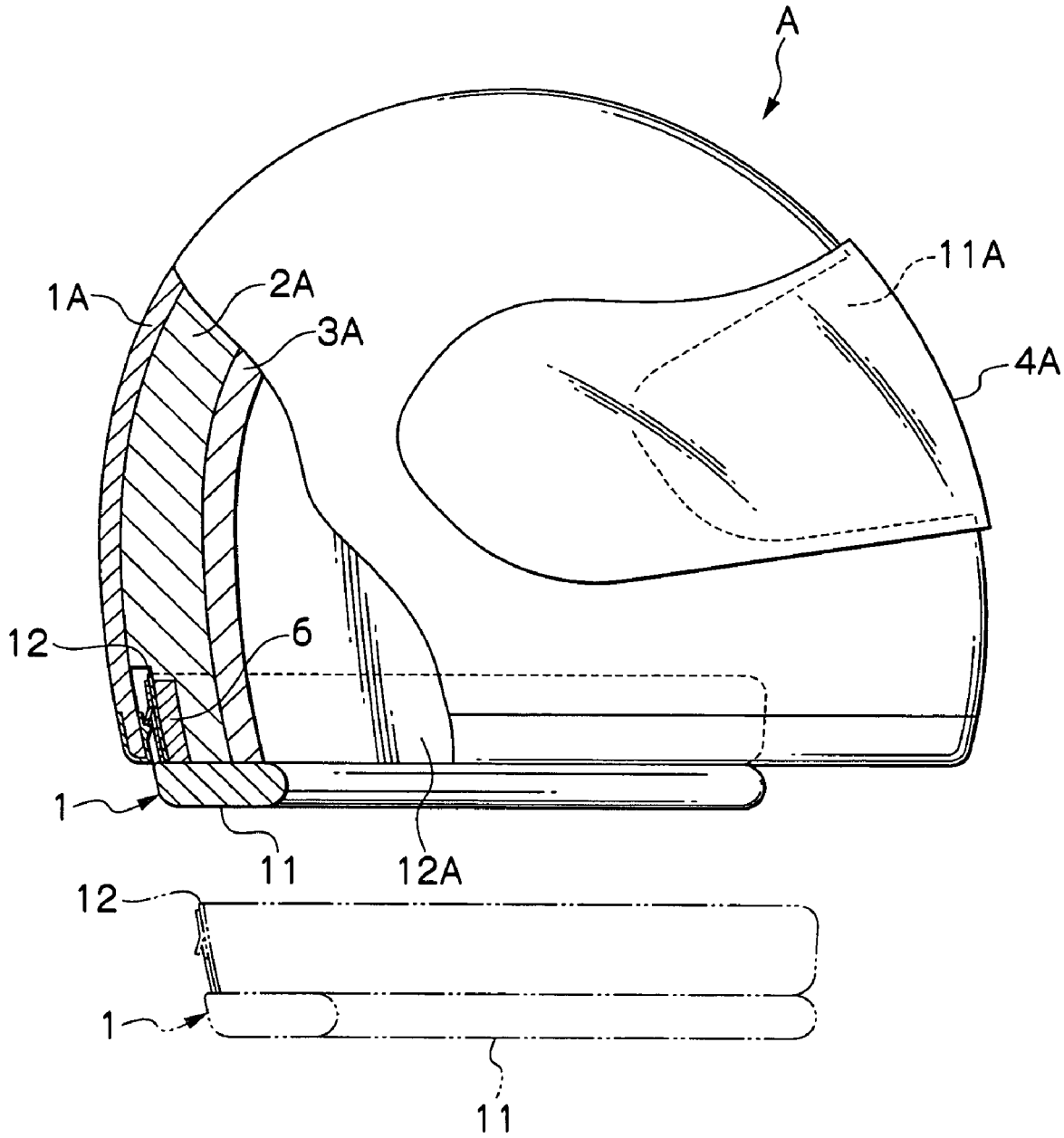
FIG. 1 is a side elevational view with a part being cut away for showing a helmet having the neck pad attachment structure in accordance with the present invention.

Referring now to the drawings, the best mode for embodying the neck pad attachment structure in accordance with the present invention will be described. The attachment structure for a neck pad 1 in this preferred embodiment is illustrated as a construction applied to a full-face type helmet A (hereinafter called as "helmet"). In addition, the configuration of the helmet A in this preferred embodiment is schematically illustrated.

The helmet A in this preferred embodiment is a full-face type helmet having a well-known configuration including a shell 1A in which a front side opening 11A is opened for exposing the face of a helmet-wearer and a putting-on or taking-off opening 12A is opened for the helmet-wearer to put on or take off the helmet A, a shock absorbing liner 2A installed inside the shell 1A, an inner liner 3A constructed of a head pad, cheek pads and a chin pad or the like (not shown) installed inside the shock absorbing liner 2A, the neck pad 1 removably installed at a location corresponding to the scope ranging from the rear head part to the side head portions of the putting-on or taking-off opening 12A, and a shield 4A for use in opening and closing the front side opening 11A.

In the following description, the front side opening 11A is defined as a front side and the putting-on or taking-off opening 12A is defined as a lower side, respectively.

Figure 2:
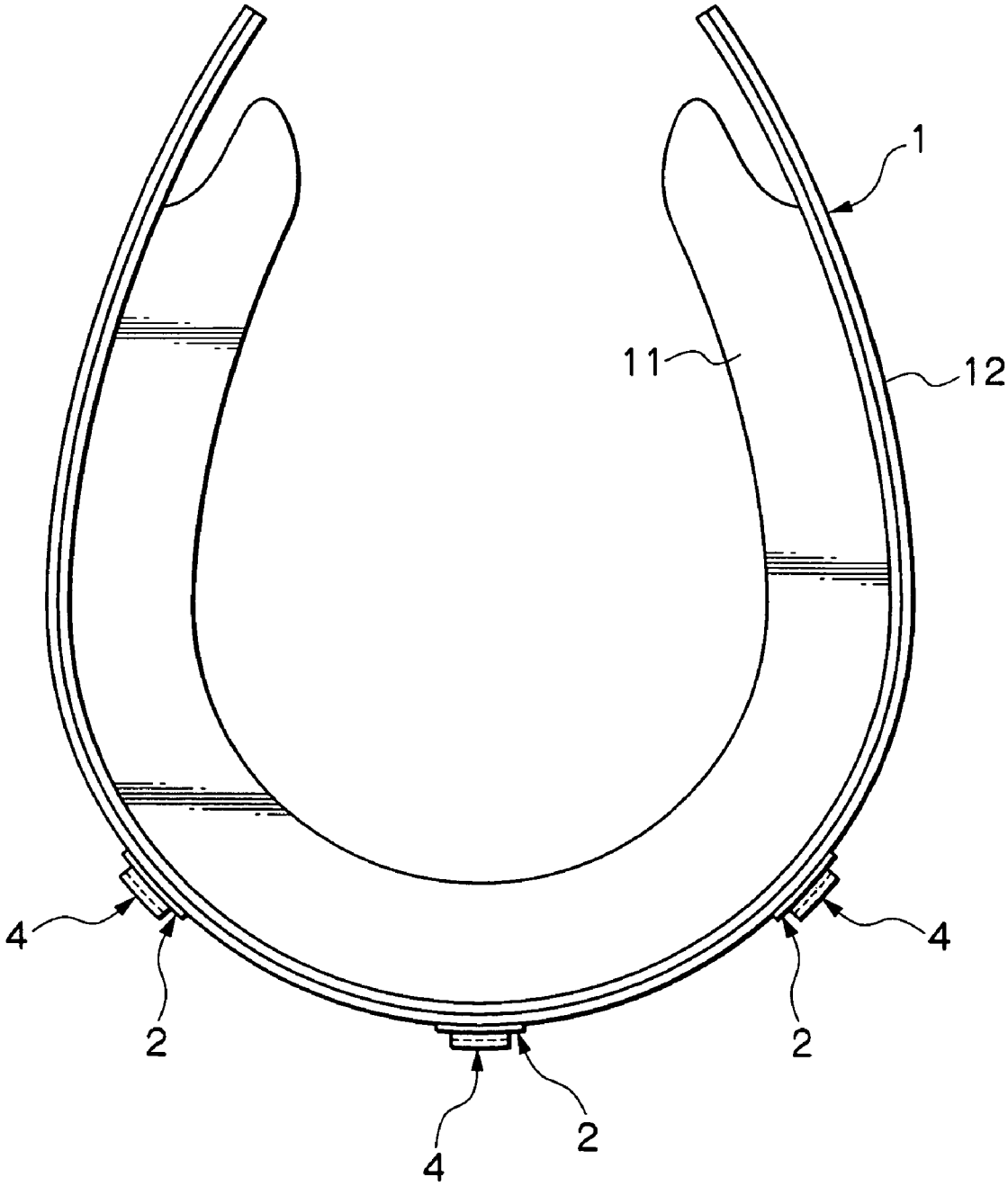
FIG. 2 is a top plan view for showing the neck pad.
Figure 3:
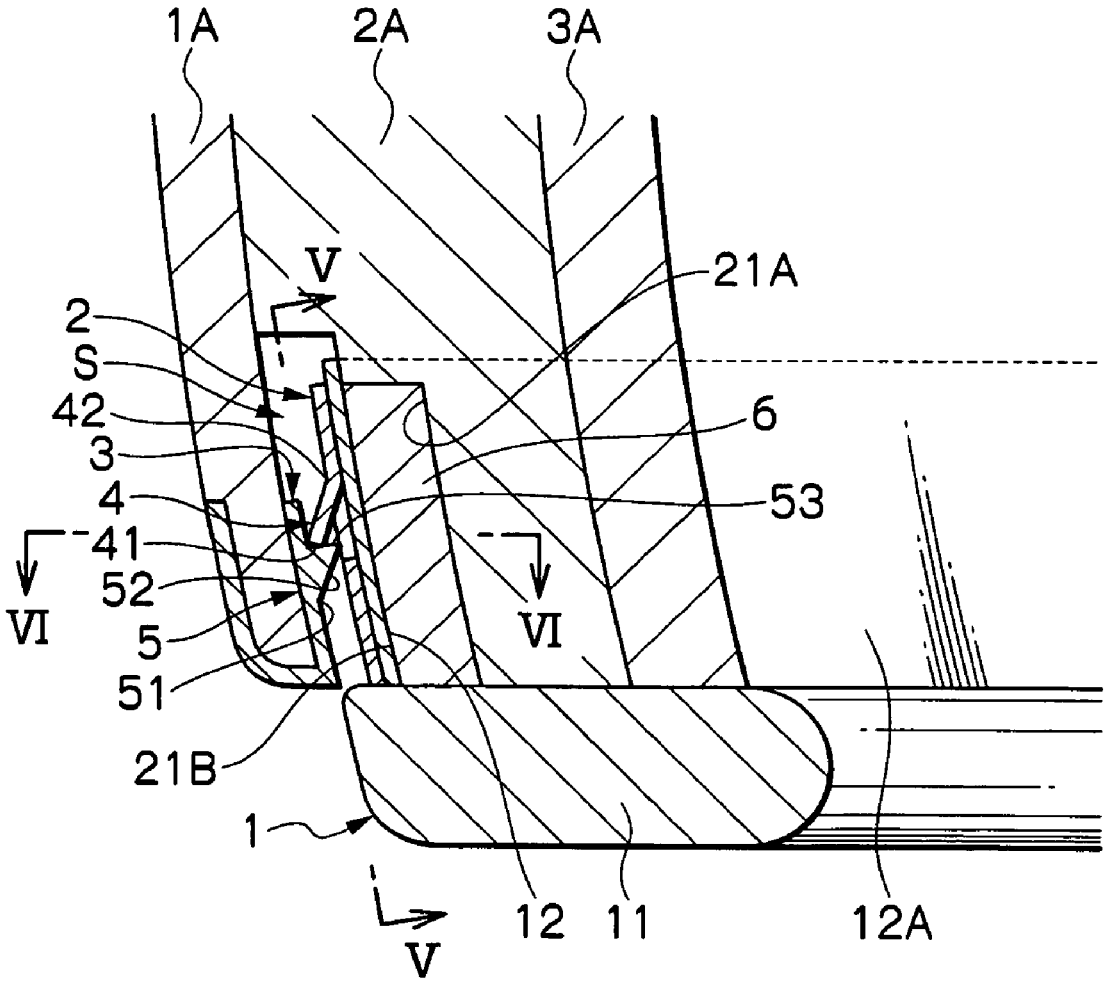
FIG. 3 is a substantial enlarged view of FIG. 1 to show a state in which the neck pad is attached.
Figure 4:
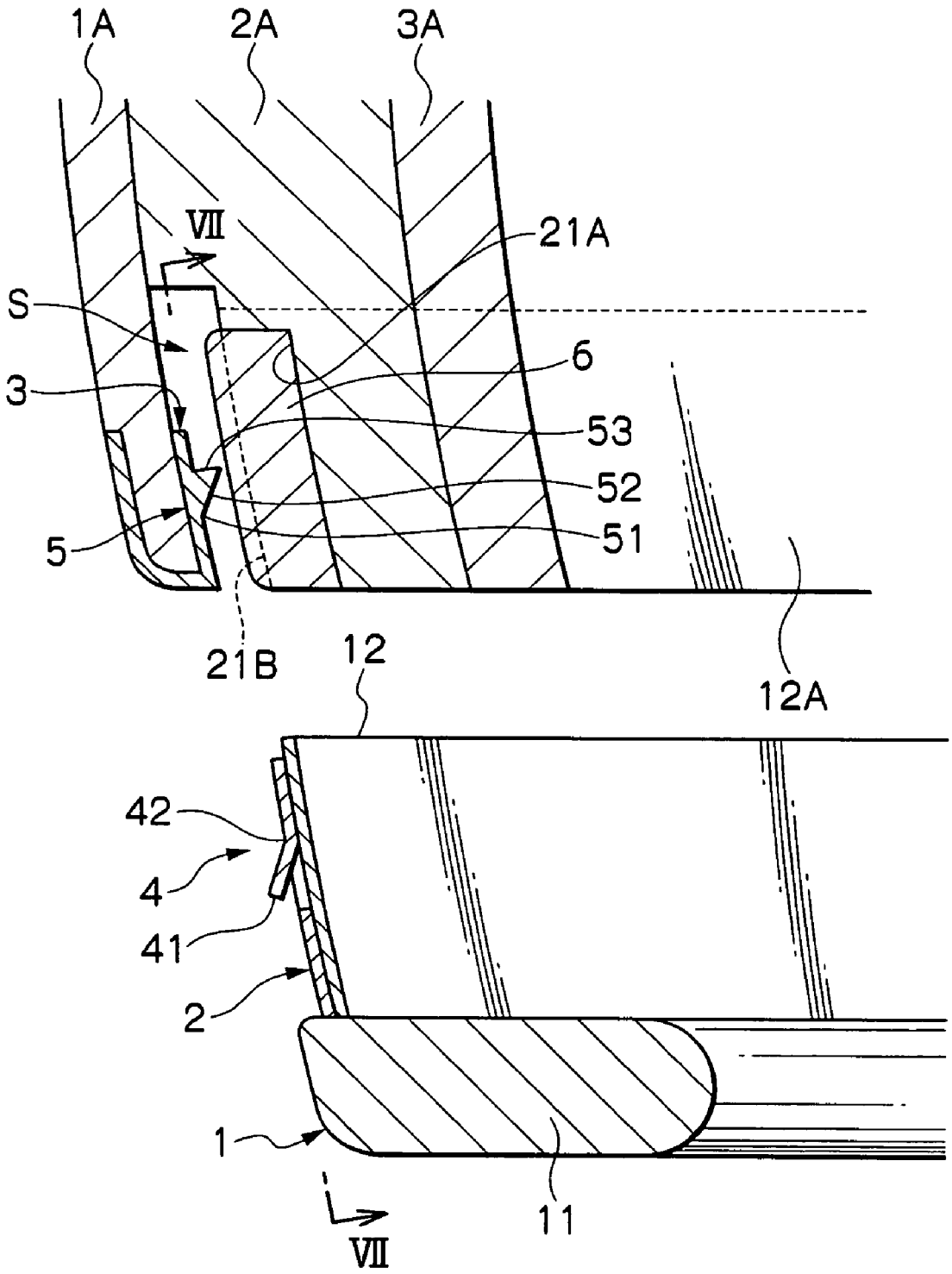
FIG. 4 is a substantial enlarged view for showing a state in which the neck pad is removed.

As shown in FIGS. 1 to 4, the neck pad 1 of the preferred embodiment is constructed of a horseshoe-shaped pad main body 11 and an inserting plate 12 vertically installed from the pad main body 11 in a vertical direction. The pad main body 11 has a cushioning characteristic in which a cushion member (not shown) is enclosed by a cover member (not shown), and the pad main body 11 is a member contacted around to the engaging member 3 and then the neck pad 1 is removed.

Figure 5:
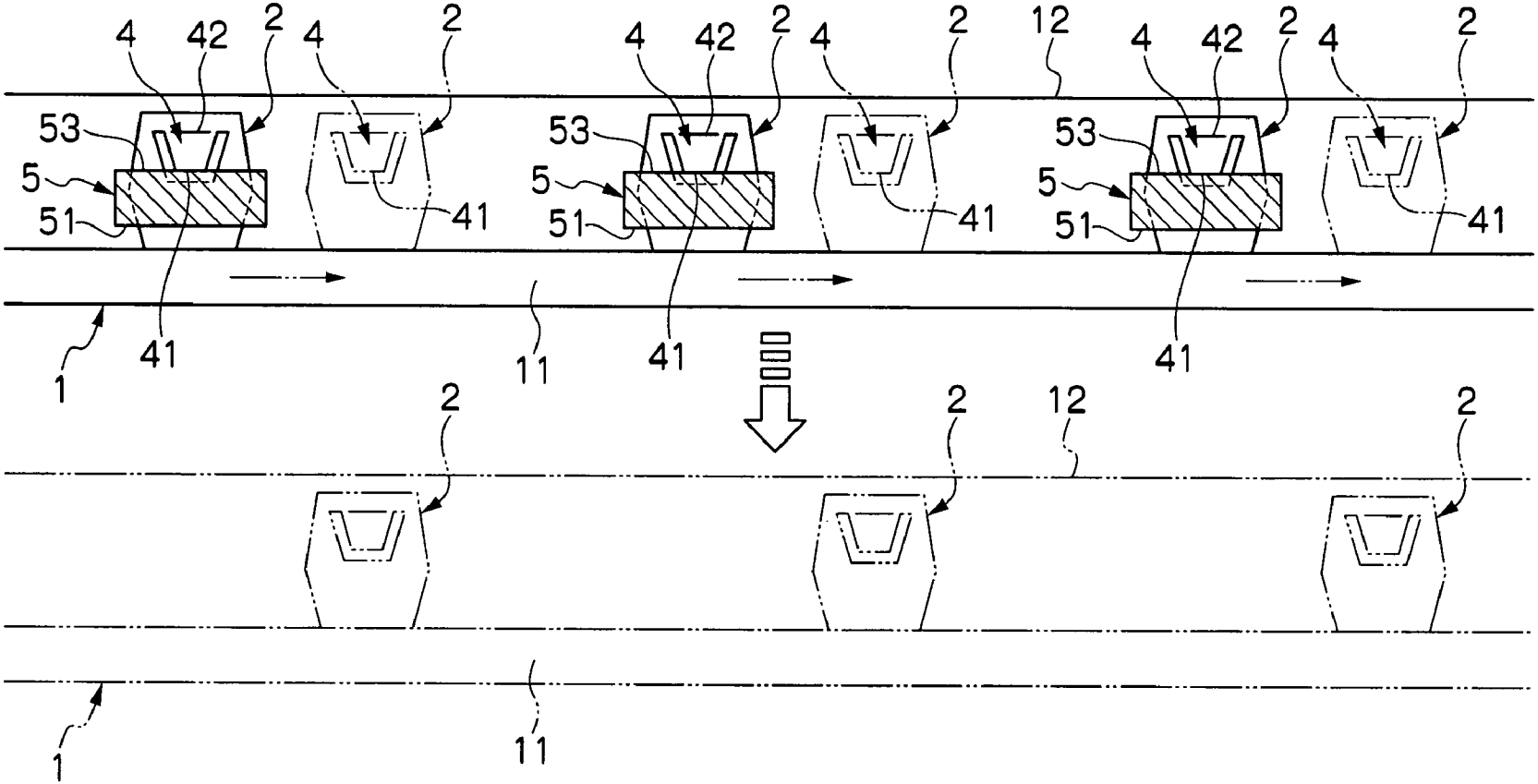
FIG. 5 is a sectional view taken along line V-V of FIG. 3 for showing it in a developed view.
Figure 6:
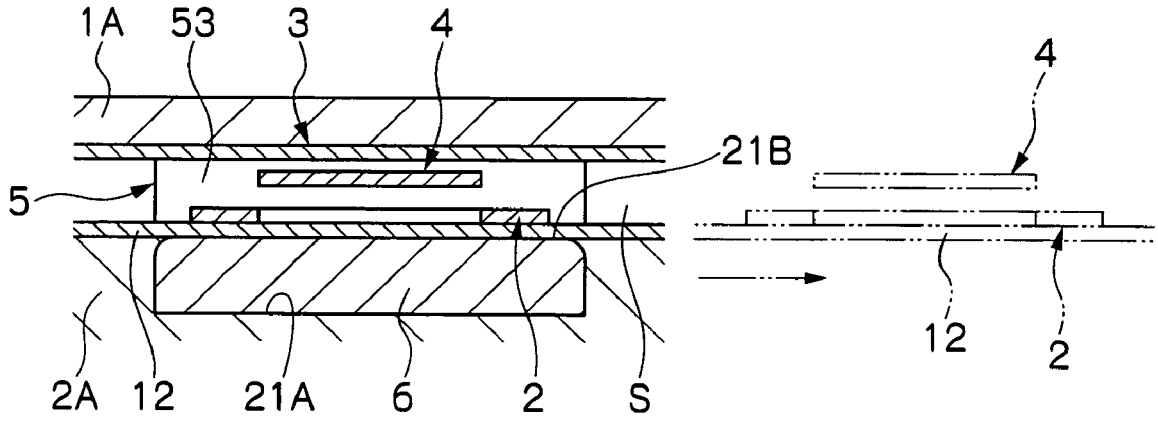
FIG. 6 is a sectional view taken along line VI-VI of FIG. 3.
Figure 7:
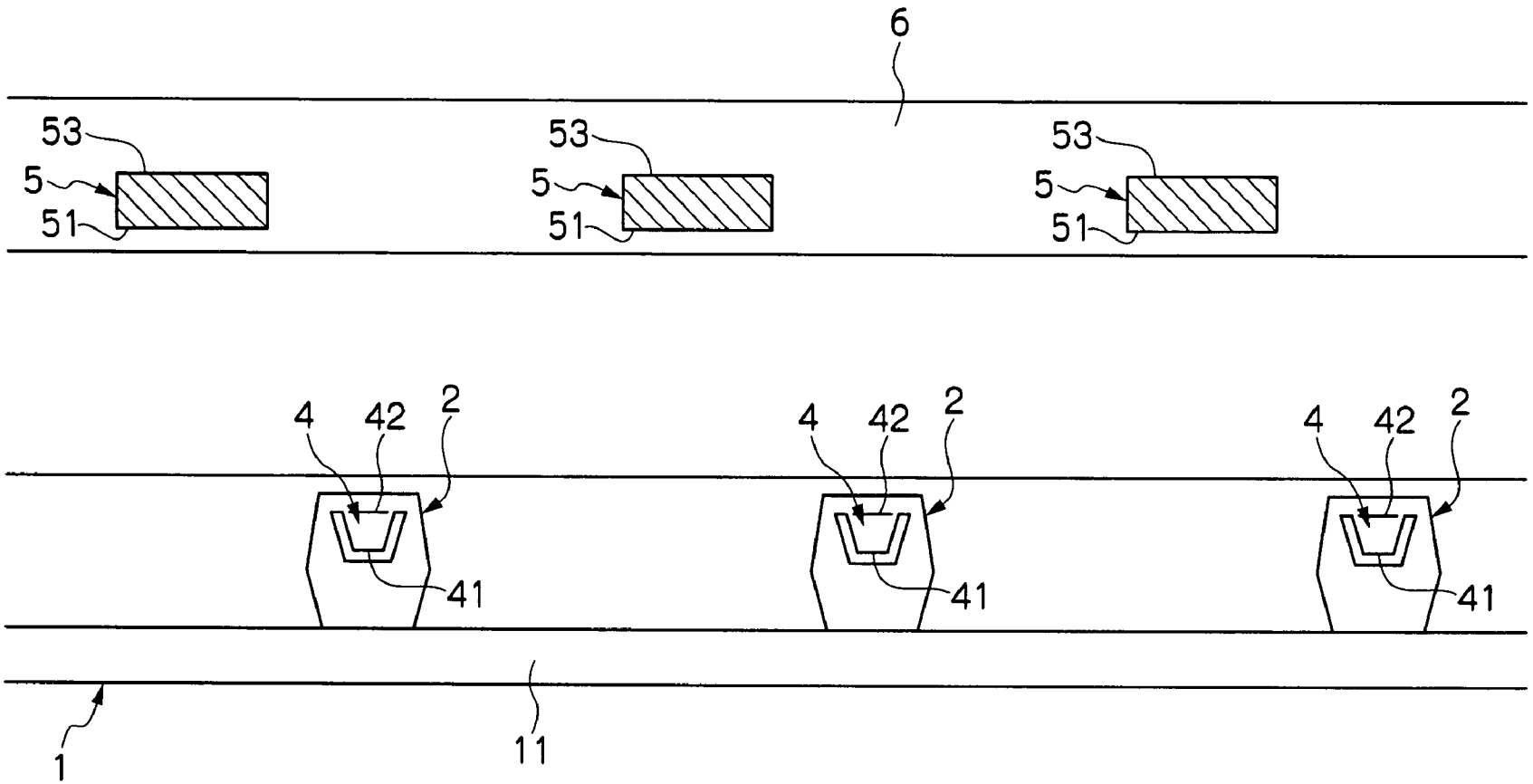
Figure 8:
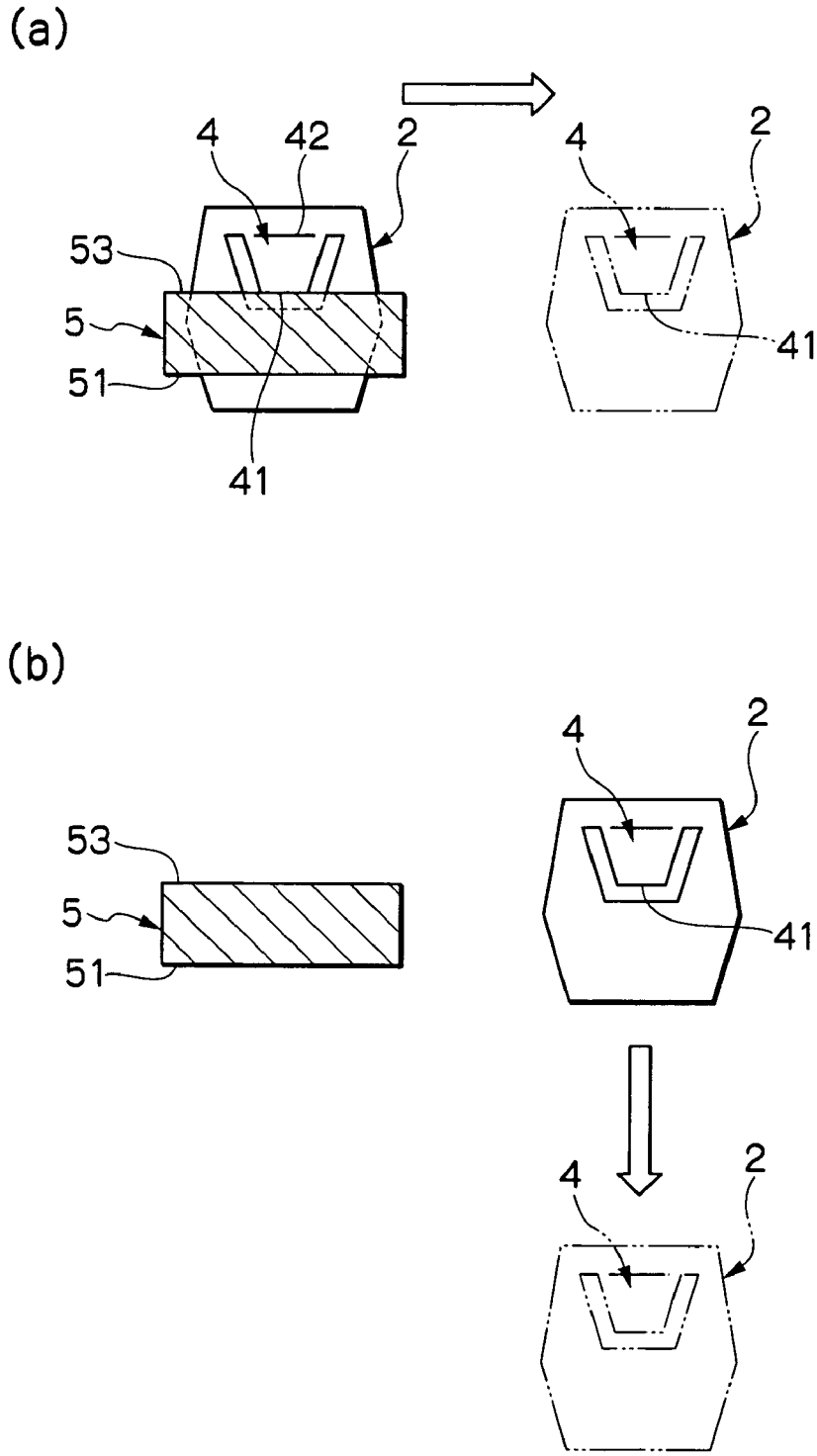
FIG. 8 is a removing step view for the neck pad, wherein FIG. 8A indicates a state in which the inserting plate is moved from a fitted state of the fitting part toward a peripheral direction to release the fitted state and FIG. 8B indicates a state in which the fitted state of the fitting part is released to pull out the inserting plate.

The attachment structure for the neck pad 1 will be described as follows. As shown in FIGS. 2 to 8, the attachment structure in this preferred embodiment is constituted by three fitting members 2 fixed to the inserting plate 12, and an engaging member 3 fixed to the shell 1A. Insertion of the inserting plate 12 causes the fitting member 2 to be resiliently fitted against the engaging member 3, thereby the neck pad 1 is attached. The inserting plate 12 is moved in a peripheral direction under a state in which the inserting plate 12 is inserted to cause the fitting member 2 to be released from its fitted state in respect to the engaging member 3 and then the neck pad 1 is removed.

As shown in FIGS. 2 to 7, the fitting member 2 is a resilient thin plate made of synthetic resin material such as polyamide resin, for example, wherein one fitting member is fixed at a rear central part of the neck pad 1 and each of the fitting members is fixed at both sides with the rear central part being applied as an interface, respectively. The surface of the fitting member 2 oppositely facing against the engaging member 3 is formed with a fitting part 4. The fitting part 4 has slits at three sides except its upper side, and the lower extremity end 41 is cut and raised to extend from the upper base end 42 toward the engaging member 3. That is, the fitting part 4 having a configuration as above tab provides a rearward repelling force (a biasing force) against a forward pushing force, so that it can be recovered back to its original shape from its forward crushed deformation.

As shown in FIGS. 3 to 7, the engaging member 3 is a band-like resilient thin plate made of synthetic resin material such as polyamide resin and is fixed to the inside part of the shell 1A so as to oppositely face the fitting member 2. Three engaging portions 5 each of which is fitted to the fitting part 4 are integrally protruded at the surface of the engaging member 3 oppositely facing against the fitting part 4. The engaging part 5 is formed with an inclined surface part 52 extending from the lower base end 51 in an upward direction toward the fitting part 4, and an engaging surface 53 to which the extremity end 41 of the fitting part 4 contacts from above and fits it is formed flat in a peripheral direction at the upper end of the inclined surface part 52.

Fitting operation of the fitting part 4 having the aforesaid configuration in respect to the engaging part 5 is carried out in such a way that when the neck pad 1 is fixed, the inserting plate 12 is inserted into the helmet with the fitting part 4 oppositely faced against the engaging part 5 in a vertical direction, the extremity end 41 of the fitting part 4 moves upward while in contact with the inclined surface 52 of the engaging part 5, and the fitting part 4 is crushed forwardly as this motion occurs and is deformed. Further, when the inserting plate 12 is inserted, the extremity end 41 rides over the inclined surface 52 and the fitting part 4 is recovered into its original shape from its crushed deformation shape under an action of repelling force concurrently with the riding-over action, thereby the extremity end 41 is brought into a fitted state in which it is oppositely engaged from above to the engaging surface 53 of the engaging part 5. That is, with this configuration, when a tension force acts on the neck pad 1 in a direction in which the neck pad is removed as in the case where the helmet A is hung down while the neck pad 1 is held by a hand, a force acts on the fitting part 4 so as to cause it to be moved downward, and the fitting part 4 is rigidly fitted to the engaging part 5 with this force, so that the neck pad 1 is not removed from the helmet A.

The shock absorbing liner 2A is provided with biasing means 6 for applying a biasing force against the inserting plate 12 inserted into the clearance S toward the engaging part 5. The biasing means 6 is made of a resilient material such as resilient urethane foam or rubber material that generates a repelling force (a biasing force) for returning from a crushed deformation to its original shape, and this biasing means is stored in a storing cavity 21A formed in the shock absorbing liner 2A. In addition, the biasing means 6 is adhered in the storing cavity 21A under a state in which it is protruded out of a rear opening part 21B of the storing cavity 21A.

When the inserting plate 12 is inserted into the clearance 5, the biasing means 6 is crushed and deformed by the inserting plate 12, and a repelling force for recovering its shape into its original shape concurrently with this crushed deformation may act to cause the inserting plate 12 to be pushed toward the engaging part 5. Then, forward or rearward motion of the inserting plate 12 within the clearance S is restricted by pushing the inserting plate 12 toward the engaging part 5 with this repelling force, and a positive holding of the fitting part 4 on the engaging part 5 under its fitted state can be attained.

In addition, the storing cavity 21A is formed at a location strictly opposite to the fitting part 4 under its fitted state in a forward or rearward direction, and the repelling force of the biasing means 6 is concentrically acted against the fitting part 4, thereby a more positive holding of the fitted state of the fitting part 4 on the engaging part 5 is assured.

Referring now to removing step figures of FIGS. 5 to 8A and 8B, a removing operation for the neck pad performed through a fixing structure of the neck pad 1 of this preferred embodiment will be described. The removing step figures schematically illustrate the operation when releasing a fitted state of the fitting part 4 and the engaging part 5.

As shown in FIGS. 5 to 8A, at first, the removing operation for the neck pad 1 is carried out in such a way that the neck pad main body 11 is held by hand, the inserted inserting plate 12 is moved along a peripheral direction of the helmet A, the extremity end 41 of the fitting part 4 is moved to a non-opposite position of the engaging surface 53 of the engaging part 5, thereby the fitted state of the fitting part 4 on the engaging part 5 is released, allowing the inserting plate 12 to be removed out of the clearance S. Then, as shown in FIGS. 5 to 8B, the pad main body 11 is pulled down to cause the inserting plate 12 to be pulled out of the clearance S and the neck pad 1 can be taken out.

That is, the attachment structure for the neck pad 1 in this preferred embodiment enables the neck pad 1 to be removed by moving the inserting plate 12 in a peripheral direction and pulling out the inserting plate 12. Further, releasing of the fitted state of the fitting part 4 in respect to the engaging part 5 is carried out under a state in which the extremity end 41 of. the fitting part 4 moves on the engaging surface 53 of the engaging part 5 in a peripheral direction. Accordingly, a smooth releasing operation for the fitted state can be carried out under low resistance at the time of releasing of the fitted state with a low force. Further, since the engaging surface 53 is flat in its peripheral direction, the releasing operation for the fitted state can be carried out from any direction in the peripheral direction. Further, in the case of fitting of the fitting part 4 in respect to the engaging part 5, action of the tension force in respect to the neck pad 1 as described above causes a fitting of the fitting part 4 in respect to the engaging part 5 to become more rigid, assuring a positive fitted state.

Accordingly, the attachment structure for the neck pad 1 in this preferred embodiment enables a removal of the neck pad 1 to be easily carried out with a smaller force with a positive attached state of the neck pad 1 assured.

Further, in order to attach the neck pad 1 at an accurate position, marks indicating the attaching position may be attached to the neck pad 1 and the shell 1A or the neck pad 1 and the shock absorbing liner 2A (not shown). Although the attachment structure for the neck pad 1 is illustrated in a form in which the engaging member 3 is fixed to the shell 1A, the engaging member 3 may be fixed to the shock absorbing liner 2A (not shown). Further, although the attachment structure for the neck pad 1 is illustrated with the fitting member 2 formed with the fitting part 4 being fixed to the inserting plate 12 as a separate member, the fitting part 4 may be directly formed at the inserting plate 12 (not shown). Further, although the attachment structure for the neck pad 1 is illustrated under a form in which the fitting part 4 has a resiliency and is engaged with the engaging part 5 with this resiliency, the engaging part 5 may have resiliency and the fitting part 4 may be engaged with the engaging part 5 with this resiliency (not shown). Further, although the attachment structure for the neck pad 1 is illustrated under a state with the biasing means 6 arranged at a location where it is accurately opposed against the fitting part 4, the biasing means 6 may be arranged. Over an entire length of the inserting plate 12 or arranged at a part including all the fitting parts 4 (not shown).

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A combination of a helmet and a separate neck pad, said helmet comprising a shell and a shock-absorbing liner within the shell, said shell and said shock-absorbing liner defining a peripheral channel therebetween that extends around a lower side opening of the helmet for a head of a user, said neck pad comprising a main body and a curved plate which extends away from the main body and is insertable in the peripheral channel in said helmet, said helmet including a plurality of spaced engaging members in said peripheral channel and said neck pad including a plurality of correspondingly spaced fitting members on said curved plate, at least one of said plurality of engaging members comprising an inclined surface which extends into said peripheral channel and an engaging surface at an end of said inclined surface, and at least one of said plurality of fitting members comprising a tab which extends away from said curved plate, said fitting members and said engaging members being biased such that when said curved plate is inserted in said peripheral channel during attachment of said neck pad to said helmet, said tab of said at least one of said plurality of fitting members will contact, then ride over said inclined surface of said at least one engaging member, and then engage with said engaging surface of said at least one engaging member, whereas when said neck pad is disengaged from said helmet, said neck pad is rotated relative to said helmet such that said fitting members will move along said peripheral channel out of alignment with said engaging members, enabling removal of said curved plate from within said peripheral channel.

2. The combination of claim 1, including a biasing means in said shock-absorbing liner for biasing said curved plate outwardly toward said shell to bias said fitting members toward said engaging members.

3. The combination of claim 2, wherein said biasing means comprises a block of resilient urethane foam.

4. The combination of claim 2, wherein said biasing means comprises a block of rubber.

5. The combination of claim 1, wherein said removable neck pad has a horseshoe shape.

* * * * *